US008395135B2

(12) United States Patent
Klokkenburg et al.

(10) Patent No.: US 8,395,135 B2
(45) Date of Patent: Mar. 12, 2013

(54) DEVICE AND A METHOD FOR CURING PATTERNS OF A SUBSTANCE AT A SURFACE OF A FOIL

(75) Inventors: Mark Klokkenburg, Utrecht (NL); Gerardus Titus Van Heck, Eindhoven (NL); Eric Rubingh, Geldrop (NL); Tim J. Van Lammeren, Eindhoven (NL); Hieronymus A. J. M. Andriessen, Beerse (BE)

(73) Assignee: Nederlandse Organisatie voor toegepast-natuurwetenschappelijk onderzoek TNO, Delft (NL)

( * ) Notice: Subject to any disclaimer, the term of this patent is extended or adjusted under 35 U.S.C. 154(b) by 0 days.

(21) Appl. No.: 13/121,200

(22) PCT Filed: Sep. 28, 2009

(86) PCT No.: PCT/NL2009/050581

§ 371 (c)(1),
(2), (4) Date: Jun. 13, 2011

(87) PCT Pub. No.: WO2010/036116

PCT Pub. Date: Apr. 1, 2010

(65) Prior Publication Data

US 2011/0233425 A1 Sep. 29, 2011

(30) Foreign Application Priority Data

Sep. 29, 2008 (EP) ..... 08165395

(51) Int. Cl.
*A61N 5/06* (2006.01)
*B05D 3/06* (2006.01)

(52) U.S. Cl. ..... 250/504 R; 250/338.1; 250/461.1; 347/102; 427/558; 427/559

(58) Field of Classification Search ..... 250/338.1, 250/339.06, 341.1, 363.01, 365, 372, 461.1, 250/492.1, 504 R; 427/541, 542, 557–559, 427/572; 347/100–102
See application file for complete search history.

(56) References Cited

U.S. PATENT DOCUMENTS
(Continued)

FOREIGN PATENT DOCUMENTS

EP 0 228 896 A1 7/1987
EP 0 314 174 A1 5/1989
(Continued)

OTHER PUBLICATIONS

Chou et al., "Fabrication and sintering effect on the morphologies and conductivity of nano-Ag particle films by the spin coating method.", Nanotechnology, 16:779-784 (2005).

(Continued)

*Primary Examiner* — Bernard E Souw
(74) *Attorney, Agent, or Firm* — Novak Druce Connolly Bove + Quigg LLP

(57) ABSTRACT

A device is described for curing patterns of a substance at a surface of a foil. The device a carrier facility for carrying the foil within an object plane, a photon radiation source arranged at a first side of the object plane for emitting photon radiation in a wavelength range for which the foil is transparent, and a first and a second concave reflective surface arranged at mutually opposite sides of the object plane for mapping photon radiation emitted by the photon radiation source into the object plane. Therein the photon radiation source is arranged between the first concave reflecting surface and the object-plane. The photon radiation of the photon radiation source is concentrated into the object plane by the first and the second concave reflective surface.

20 Claims, 6 Drawing Sheets

U.S. PATENT DOCUMENTS

| | | | | |
|---|---|---|---|---|
| 4,287,226 | A * | 9/1981 | Pirvics et al. | 427/510 |
| 6,797,971 | B2 * | 9/2004 | Cekic et al. | 250/504 R |
| 6,858,253 | B2 * | 2/2005 | Williams et al. | 427/277 |
| 7,777,198 | B2 * | 8/2010 | Rocha-Alvarez et al. | 250/455.11 |
| 2002/0092467 | A1 | 7/2002 | Stowe | |
| 2003/0227527 | A1 * | 12/2003 | Richards | 347/102 |
| 2004/0009304 | A1 * | 1/2004 | Pichler et al. | 427/551 |
| 2004/0011969 | A1 * | 1/2004 | Cekic et al. | 250/504 R |
| 2006/0049396 | A1 * | 3/2006 | Pichler et al. | 257/40 |
| 2006/0257796 | A1 | 11/2006 | Moriya et al. | |
| 2007/0110893 | A1 | 5/2007 | Lennon et al. | |
| 2008/0020304 | A1 | 1/2008 | Schroder et al. | |
| 2011/0283533 | A1 * | 11/2011 | Perelaer et al. | 29/846 |

FOREIGN PATENT DOCUMENTS

| | | | |
|---|---|---|---|
| EP | 1 849 615 | A1 | 10/2007 |
| EP | 1 914 084 | A1 | 4/2008 |
| FR | 2 629 187 | A1 | 9/1989 |
| JP | 5-229855 | A | 9/1993 |
| JP | 2000-117960 | A | 4/2000 |
| WO | 2006/071419 | A2 | 7/2006 |
| WO | 2007/039227 | A1 | 4/2007 |

OTHER PUBLICATIONS

Schroder et al., "Broadcast Photonic Curing of Metallic Nanoparticle Films.", NSTI Nanotech, Boston, May 7-11, 2006, 5 pages.

* cited by examiner

DEVICE AND A METHOD FOR CURING PATTERNS OF A SUBSTANCE AT A SURFACE OF A FOIL

CROSS-REFERENCE TO RELATED APPLICATIONS

This application is filed under 35 U.S.C. 371 as a U.S. national phase application of PCT/NL2009/050581, having an international filing date of 28 Sep. 2009, which claims the benefit of European Patent Application No. 08165395.8, having a filing date of 29 Sep. 2008, both of which are hereby incorporated by reference.

BACKGROUND OF THE INVENTION

1. Field of the Invention

The present invention relates to a device for curing patterns of a substance at a surface of a foil. The present invention further relates to a method for curing patterns of a substance at a surface of a foil.

2. Related Art

Substances, such as conductive inks, on flexible substrates like PEN and PET are often difficult to cure/sinter because of their relatively high curing temperature, which is often not compatible with polymeric substrates. As a result, it is difficult to find a method that effectively (good conductivity, fast, cheap, and large area compatible) cures wet ink lines into conductive tracks without deforming the polymeric substrate.

WO2006/071419 describes a photonic curing system, wherein a substrate provided with a metallic nano-ink is guided by a conveyor belt below a strobe head. Nano-ink comprises a dispersion of nanometer sized metal particles in oil or water. The metal used for these particles is usually silver as it is highly conductive and does not oxidize readily, but also other metals like copper are possible. By using nanometer-sized particles a high resolution of the conductive pattern to be formed can be achieved. The strobe head comprises a photon emission source, such as a xenon flash lamp. It is noted that JP2000117960 describes an inkjet printing method and apparatus. FIG. 2 thereof shows an apparatus, wherein a foil provided with a printed ink-layer is carried between a first and a second light source, each having a reflector. JP2000117960 does not specify how the reflectors map the light emitted by the light sources.

It is desired to improve the efficiency of the apparatus so that a higher throughput is possible without increasing the power of the lamp.

SUMMARY OF THE INVENTION

According to an aspect a device is provided for curing patterns of a substance at a surface of a foil. The device comprises a carrier facility for carrying the foil within an object plane, a photon radiation source arranged at a first side of the object plane for emitting photon radiation in a wavelength range for which the foil is transparent, a first and a second concave reflective surface arranged at mutually opposite sides of the object plane, for mapping radiation emitted by the photon radiation source into the object plane, the photon radiation source being arranged between the first concave reflecting surface and the object-plane, characterized in that the photon radiation of the photon radiation source is concentrated into the object plane by the first and the second concave reflective surface. The photon radiation source is a tubular radiator with a length-axis and the first and the second reflecting surfaces are cylindrical surfaces extending along the length axis, and wherein the first and the second concave reflective surface each have a first and a second focal line, wherein the second focal lines of the first and the second concave reflective surfaces at least substantially coincide with each other in the object-plane, and wherein the tubular radiator at least substantially coincides with the first focal line of one of the first and the second concave reflective surfaces.

According to a further aspect a method is provided for curing patterns of a substance at a surface of a foil. The method comprises the steps of carrying the foil within an object plane, emitting photon radiation by a tubular radiator with a length-axis from a first side of the object plane in a wavelength range for which the foil is transparent, mapping a first part of the emitted photon radiation directly by reflection at a first concave cylindrical reflecting surface extending along the length axis towards the object plane mapping by reflection at a second concave cylindrical reflecting surface extending along the length axis a second part of the emitted photon radiation that is transmitted by the foil by reflection towards the object plane characterized in that the mapped first part and second part of the photon radiation of the photon radiation source is concentrated into the object plane wherein the first and the second concave reflective surface each have a first and a second focal line, wherein the second focal lines of the first and the second concave reflective surfaces at least substantially coincide with each other in the object-plane, and wherein the tubular radiator at least substantially coincides with the first focal line of one of the first and the second concave reflective surfaces.

In the device and method according to the present invention photon radiation emitted by the photon radiation source is mapped by the reflecting surfaces. By "reflective" is meant that the amount of radiation reflected from the surface is high, with reflectivities typically greater than 50%, more typically greater than 80%, at the wavelength of interest.

Not only radiation directly emitted by the photon radiation source is used to irradiate the substance, but also radiation that passes beyond the object plane, and that would otherwise have been lost, is now reflected again towards the object plane. Radiation may be repeatedly reflected between the reflecting surfaces until it is absorbed by the substance to be cured. By using radiation having a wavelength for which the substrate is transparent, the radiation may therewith pass through the object plane. By "transparent" is meant that attenuation of radiation as it passes through the region of interest is low, with transmissivities typically greater than 50%, more typically greater than 80%, at the wavelength of interest.

Therewith an increase in efficiency is obtained, that is substantially more than that would be obtained if the substrate is merely illuminated by two radiation sources from both sides. In a practical situation, for example 10% of the radiation is absorbed by the substance to be cured, and the remainder is transmitted. In the device according to the present invention, using multiple reflections, as much as 80% may be absorbed by the substance. Hence an efficiency improvement of 800% is achieved.

The photon radiation source is a tubular radiator with a length-axis and the first and the second reflecting surfaces are cylindrical surfaces extending along the length axis. In this way the radiation is concentrated in an elongated zone extending in the direction of said length axis. In this embodiment a large surface of a foil can be irradiated with substantially the same radiation dose, i.e. the integral of radiation power in time. This is particularly attractive for application in roll to roll processes.

A very concentrated zone of radiation in the object-plane is obtained in a device according to the invention wherein the cylindrical surfaces are elliptical cylindrical surfaces. In this way radiation emitted by the radiation source is focused in the object-plane.

In the device according to the present invention the first and the second concave reflective surface each have a first and a second focal line, wherein the second focal lines of the first and the second concave reflective surfaces at least substantially coincide with each other in the object-plane, and wherein the tubular radiator at least substantially coincides with the first focal line of one of the first and the second concave reflective surfaces.

In an embodiment the device has a further tubular radiator that at least substantially coincides with the first focal line of the other one of the first and the second concave reflective surfaces.

The tubular radiator is considered to substantially coincide with the first focal line of a concave reflective surfaces if the tubular radiator surrounds the first focal line. In an embodiment the first focal line may coincide with the axis of the tubular radiator.

The second focal lines of the first and the second concave reflective surfaces are considered to substantially coincide with each other in the object-plane if they are not further apart from each other than one fifth of the distance between the first focal lines.

In a practical embodiment of the device according to the invention the cylindrical surfaces are formed by an inner surface of a tube. By integrating the cylindrical surfaces in the form of a tube a large reflecting surface with a high structural integrity is obtained.

In an embodiment the tube is provided with at least a first slit shaped opening extending in the direction of the length axis, wherein the carrying facility forms a guidance facility for guiding the foil through the at least slit-shape opening along the object-plane. In this way the device is made suitable for application in a roll to roll process.

In a particular embodiment a first and a second slit-shaped opening are defined between the first and the second reflecting surface, which first and second slit-shaped openings extend opposite to each other in the direction of the length axis, and wherein the carrying facility forms a guidance facility that during an operational state guides the foil via the first slit-shaped opening towards the object-plane between the first and the second reflective surfaces and away from there via the second slit-shaped opening. In this way the space between the first and the second concave reflecting surfaces can be kept substantially free from photon radiation absorbing elements, therewith improving efficiency.

In an embodiment of this embodiment the first and second concave reflective surface have a total area that is at least 5 times an area formed by the first and the second slit-shaped openings. For substances having a transmission higher than ⅔, this allows for an improvement of the absorption of the radiation emitted by the radiation source by more than a factor 2 as compared to the absorption in the absence of multiple reflections.

An efficient conditioning of the environment is in particular obtained in an embodiment of the device wherein the first and the second cylindrical surfaces are mutually connected at their ends by end parts. Apart from the optionally present slit-shaped opening(s) the first and the second cylindrical surfaces and the end parts form a substantially closed system. This allows for more complex curing processes such as hybrid curing. For example, since it is a closed system the atmosphere could be replaced by a plasma to treat the surface before or after flash sintering has been applied. Alternatively, the enclosed system provides the opportunity to work in inert atmospheres like N2. If desired the slit-shaped openings may extend into an atmosphere decoupling slot. An atmosphere decoupling slot is defined herein as a slit having a cross-section that is sufficient high and wide to permit the foil to pass through, but sufficiently narrow and long in the direction of transport of the substrate to substantially counteract a transport of gases and/or vapors to or from the environment enclosed by the cylindrical surfaces and the end parts.

In an embodiment the end-parts each are provided with a ventilation facility. The ventilation facility may be used to control a temperature within the enclosed environment. For example an excess of heat produced by the photon radiation source may be exhausted out of the enclosed environment. Alternatively hot-air may provided via the ventilation facility to support the photon radiation source in heating the substance to be cured, in those cases where the substrate is relatively heat resistant. Additionally the ventilation facility may be used to exhaust vapors that are released during the curing process or to supply a suitable atmosphere e.g. an inert atmosphere by supplying N2.

The components of the device, such as the photon radiation source, the guidance facility and the ventilation system are preferably controlled by a control unit. Preferably the control unit is a programmable control unit, so that the device can be easily adapted to application for new materials.

In an embodiment the photon radiation source is arranged at a side of the substrate opposite to a side of the substrate comprising the substance. In case of a pulsed operation of the photon radiation source, the cooling down of the substance between pulses is relatively slow in this arrangement, so that a faster curing is achieved.

BRIEF DESCRIPTION OF THE DRAWINGS

These and other aspects are described in more detail with reference to the drawing. Therein.

DETAILED DESCRIPTION OF EMBODIMENTS

Figures 1, 2:
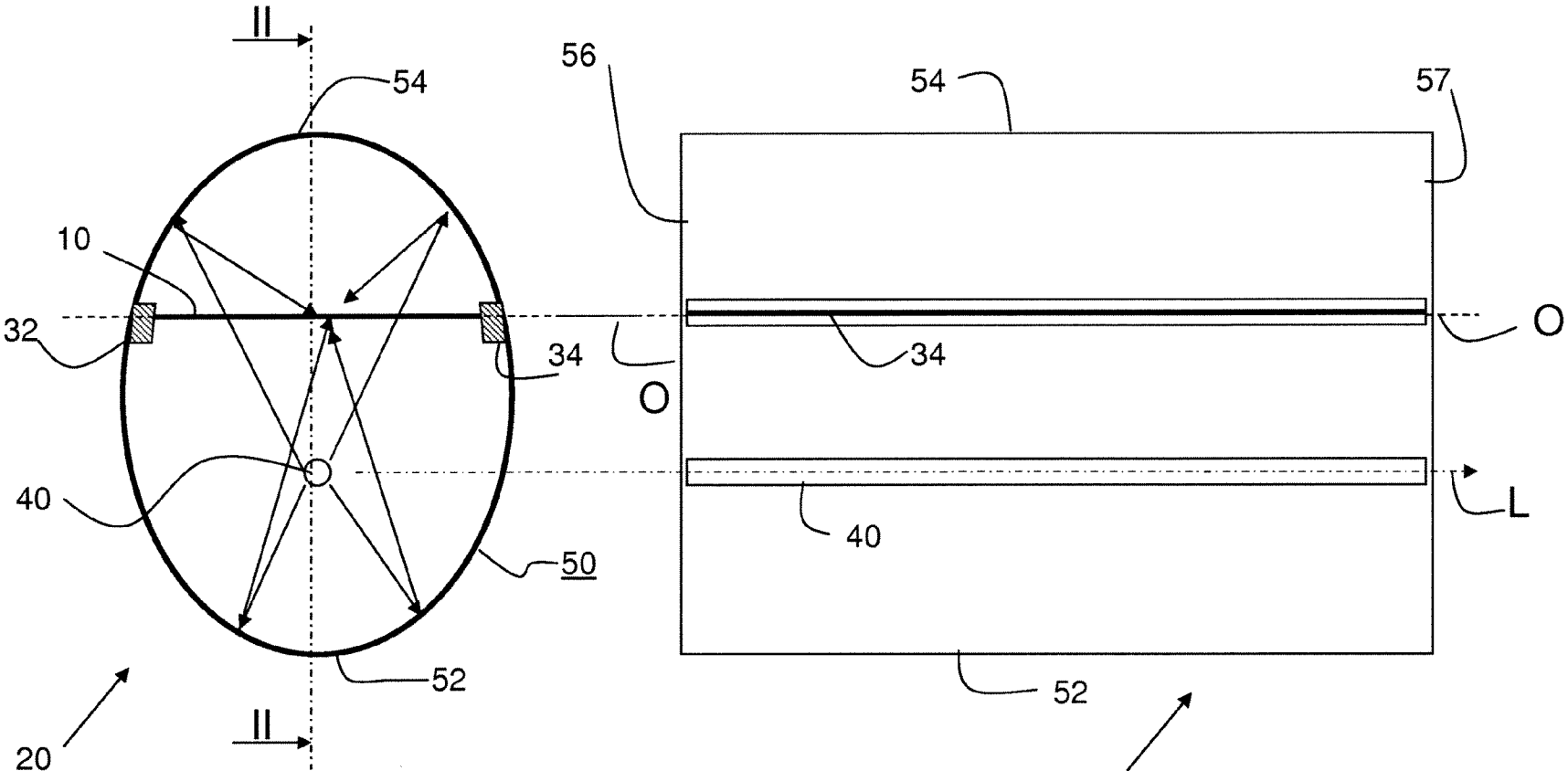
FIG. 1 shows a first embodiment of a device according to the invention, in a cross-section transverse to length axis L.
FIG. 2 shows in a further cross-section according to II-II in FIG. 1.

In the following detailed description numerous specific details are set forth in order to provide a thorough understanding of the present invention. However, it will be understood by one skilled in the art that the present invention may be practiced without these specific details. In other instances, well known methods, procedures, and components have not been described in detail so as not to obscure aspects of the present invention.

In the drawings, the size and relative sizes of layers and regions may be exaggerated for clarity.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Embodiments of the invention are described herein with reference to cross-section illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein. All publications, patent applications, patents, and other references mentioned herein are incorporated by reference in their entirety. In case of conflict, the present specification, including definitions, will control. In addition, the materials, methods, and examples are illustrative only and not intended to be limiting.

FIGS. 1 and 2 show a first embodiment of a device 20 for curing patterns of a substance at a surface of a foil 10. FIG. 1 shows a cross-section of the device 20 according to a length axis L thereof. FIG. 2 shows a cross-section according to II-II in FIG. 1. Suitable foils are for example polymer foils of the type PEN, PET, PE, PP, PVA, PI, etc and may have a thickness in a range from 70 to 500 micron for example. Instead of polymer foils also other substrates such as Silicon Nitride (SiN) and Indium Tin Oxide (ITO) may be used.

The substance at the surface of the foil is for example an ink containing metal nano particles. An example thereof is a silver nanoparticle dispersion in an ethylene glycol/ethanol mixture as provided by Cabot (Cabot Printing Electronics and Displays, USA). This silver ink contains 20 wt % of silver nanoparticles, with the particle diameter ranging from 30 to 50 nm. The viscosity and surface tension of this ink is 14.4 mPa·s and 31 mN $m^{-1}$, respectively.

Alternatively metal complexes in organic or water based solvents may be used as the substance, for example silver complex inks comprising a mixture of solvents and silver amides, for example inks produced by InkTech. The silver amides decompose at a certain temperature between 130-150° C. into silver atoms, volatile amines and carbon dioxide. Once the solvents and the amines are evaporated, the silver atoms remain on the substrate. Other metal complexes based for example on copper, nickel, zinc, cobalt, palladium, gold, vanadium, and bismuth instead of silver may be used alternatively or in combination.

Furthermore conductive pastes, with various compositions, may be used instead of inks containing metal nano particles or metal complex inks.

As shown in FIGS. 1, 2, the device comprises a carrier facility for carrying the foil 10 within an object plane O. In this case the carrier facility is formed by clamps 32, 34 that fix the foil 10 within the object plane O.

The device 20 comprises a photon radiation source 40 arranged at a first side of the object plane O. In this case a Xenon lamp is used. Instead of a Xenon flash lamp also other lamps can be applied in this configuration, even lamps that emit in another region of the electromagnetic spectrum, such as lamps that emit in the microwave, IR, and UV region. In the present embodiment the lamp is a pulsed lamp, but also continuous lamps like halogen or mercury lamps for emitting photon radiation in a wavelength range for which the foil is transparent may be used. The photon radiation source 40 in the embodiment shown is a tubular radiator 40 with a length-axis L and the first and the second reflecting surfaces (52, 54; 152, 154; 252, 254) are cylindrical surfaces extending along the length axis (L).

As shown in FIGS. 1 and 2 the device comprises a first and a second concave reflective surface 52, 54 arranged at mutually opposite sides of the object plane O. The reflective surfaces concentrate photon radiation emitted by the photon radiation source 40 into the object plane O. The photon radiation source 40 is arranged between the first concave reflecting surface 52 and the object-plane O. In the embodiment shown the photon radiation source is a tubular radiator 40 with a length-axis L and the first and the second reflecting surfaces 52, 54 are cylindrical surfaces extending along the length axis L.

The elliptical cylinder defines a first focal line extending in the length direction of the cylinder and through one of the focal points of the elliptical cross-section of the cylinder and a second focal line extending in the length direction of the cylinder and through the other one of the focal points of the elliptical cross-section of the cylinder.

However, alternative embodiments are possible. For example instead a sphere shaped radiation-source may be used in combination with first and second concave reflective surfaces in the form of hemi-ellipsoids. By selection of the position of the radiation source and of the object plane, the size of the radiated zone of the substrate can be adjusted. The photon radiation source and the object-plane may be mutually positioned so that the radiation of the source is exactly focused at the substrate. In that case the radiation is concentrated in a focal line at the substrate in the embodiment of FIG. 1, 2 or as a focal spot in case hemi-ellipsoids are used for the reflective surfaces. Alternatively, one or more of the photon radiation source or the object-plane may be displaced from this position, so that a larger zone is irradiated, albeit with a lower radiation intensity.

In the embodiment of the device 20 shown in FIGS. 1 and 2, the cylindrical surfaces 52, 54 are elliptical cylindrical surfaces. The elliptical cylindrical surfaces 52, 54 are formed by an inner surface of a tube 50. In the embodiment shown the tube is formed of aluminium, having a reflectance of 98% for the radiation emitted by the radiation source 40. But alternatively any other reflective material may be used for the tube 50, including other metals like steel, tantalum. Alternatively the tube may be provided with a reflective coating at its inner surface, e.g. a metal layer, or in the form of a Bragg-reflector. The tube 50 has closed ends 56, 57. The apparatus shown in FIGS. 1 and 2 is intended for batchwise operation. The substrate 10 provided with the substance to be cured is mounted by the clamps 32, 34 in the object-plane O and maintained there until the substance is cured.

Figure 3:
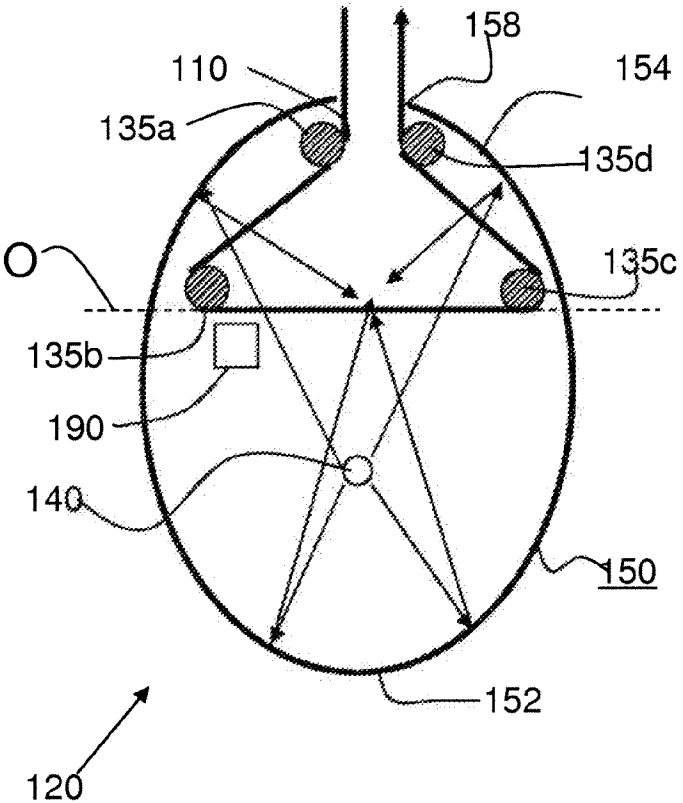
FIG. 3 shows a second embodiment of a device according to the invention, in a cross-section transverse to length axis L.

FIG. 3 shows a second embodiment. Parts therein corresponding to those in FIGS. 1 and 2 have a reference number that is 100 higher. The apparatus shown in FIG. 3 is suitable for application in a roll to roll process. In the embodiment of FIG. 3, the device comprises carrying means in the form of rolls 135*a-d*. During operation of the device 120, a foil 110 is supplied via a first slit 158 along the roll 135*a*, and subsequently transported via a roll 135*b*, along a printhead 190 for applying the substance at the foil 110, further transported along the object plane, where the substance is cured by the radiation of the radiation source 14. Subsequently the foil 110 is carried outside the tube 150 via roll 135*c* and roll 135*d*.

Figure 4:
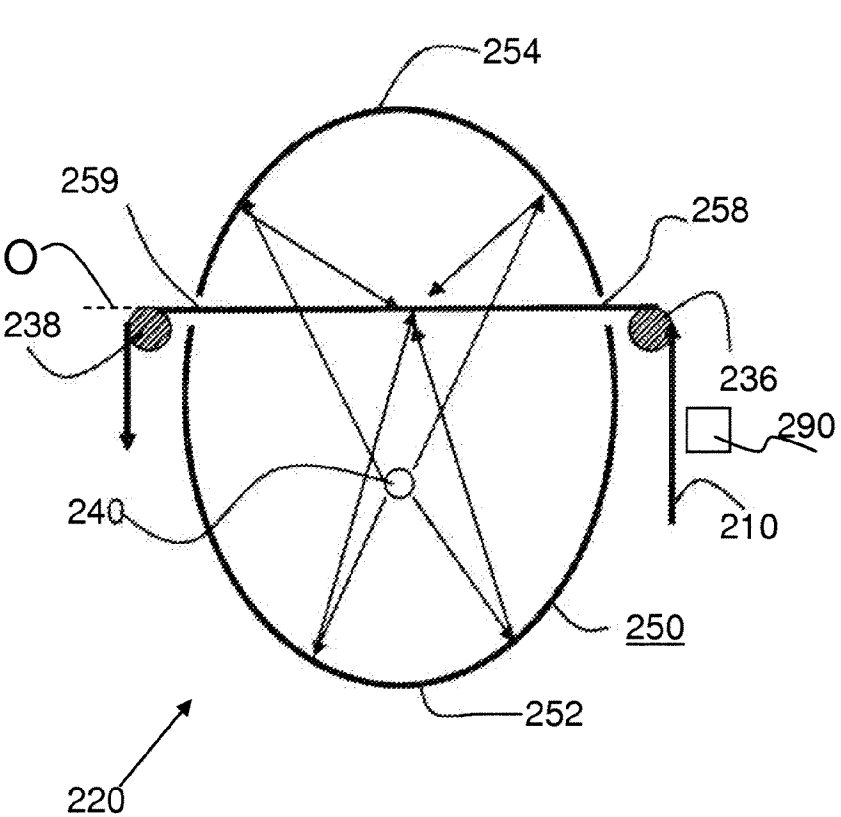
FIG. 4 shows a third embodiment of a device according to the invention, in a cross-section transverse to length axis L.
Figure 5:
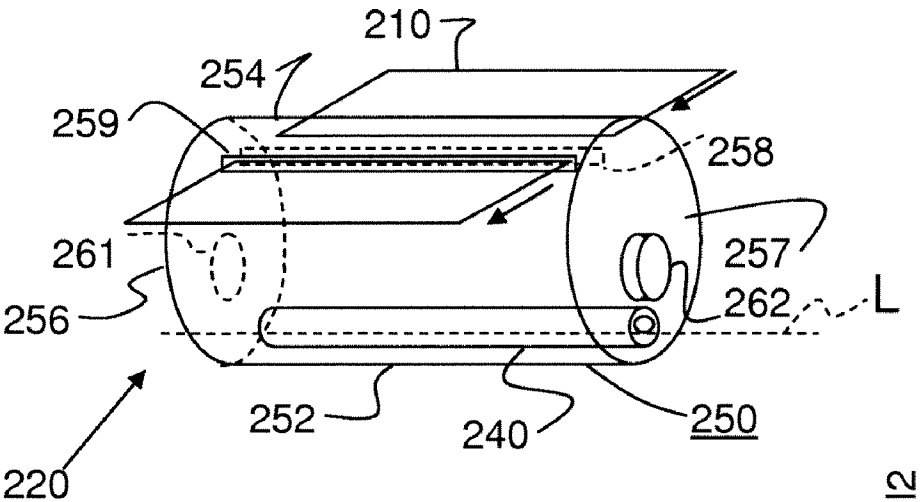
FIG. 5 shows a perspective view of the device of FIG. 4.

FIGS. 4 and 5 shows a third, improved embodiment. Parts therein corresponding to those in FIG. 3 have a reference number that is 100 higher. In the embodiment of the device according to FIGS. 4, 5 a first and a second slit-shaped opening 258, 259 are defined between the first and the second reflecting surface 252, 254. FIG. 4 shows a cross-section according to the length axis of the device 250 and FIG. 5 shows a perspective view of the device. The first and the second slit-shaped opening 258, 259 extend opposite to each other between the first and the second reflecting surface 252, 254 in the direction of the length axis. The carrying facility is formed by a guidance facility in the form of rolls 236, 238. During an operational state the rolls 236, 238 guide the foil 210 via the first slit-shaped opening 258 towards the object-plane O between the first and the second reflective surfaces 252, 254 and away from there via the second slit-shaped opening 259. In this embodiment the carrying facility 236, 238 as well as the print head 290 are arranged outside the environment between the first and the second reflective surfaces 252, 254, so that absorption of radiation by these facilities is avoided. As shown further in FIG. 5, the end parts 256, 257 are each provided with a ventilation facility 261, 262.

Figure 6:
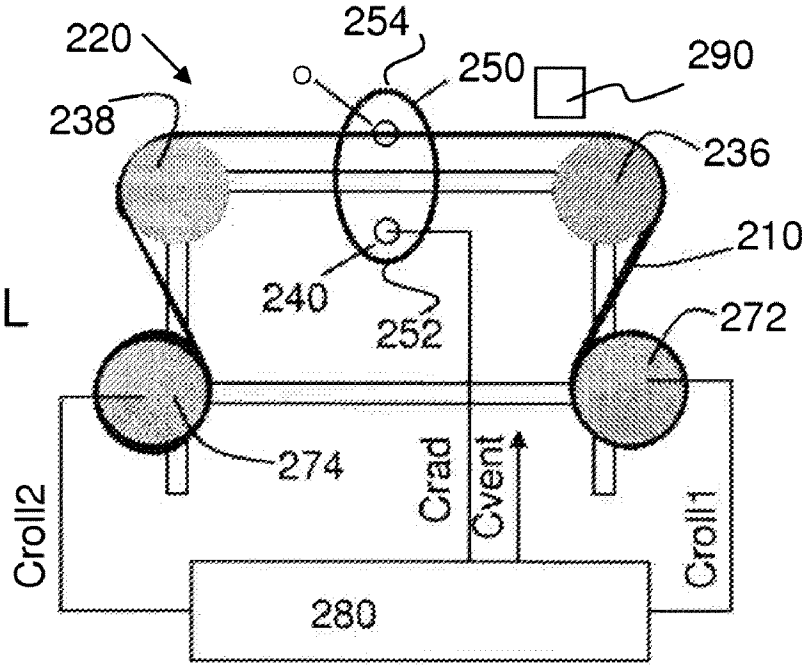
FIG. 6 shows a curing system comprising the device shown in FIGS. 4 and 5.

FIG. 6 shows a system comprising a device 220 as shown in FIGS. 4, 5. The system shown in FIG. 6 further comprises a supply roll 272 for supplying the substrate foil and a storage roll 274 for storing the printed substrate foil 210. In addition the system comprises a controller 280 that controls the photon radiation source 240 by a signal Crad. The controller 280 allows changing settings like lamp intensity, pulse duration, interval time, and the number of pulses, to find the optimal settings for curing. The controller 280 further controls an actuator (not shown) for the supply roll 272 by a signal Croll1 and an actuator (not shown) for the storage roll 274 by a signal Croll2 and the ventilation system 261, 262 by a signal Cvent.

During operation of the system a method is carried out that comprises the steps of carrying the foil 210 within an object plane O, emitting photon radiation from a first side of the object plane O in a wavelength range for which the foil 210 is transparent, mapping a first part of the emitted photon radiation directly by reflection towards the object plane O, mapping a second part of the emitted photon radiation that is transmitted by the foil by reflection towards the object plane O. The mapped first part and second part of the photon radiation of the photon radiation source is concentrated into the object plane.

A method according to the invention was applied to a Polyethylene Naphthalate (PEN) foil, having a thickness of 125 μm, that was provided with a pattern of lines having a width of 500 μm of conductive ink. As the conductive ink, a silver nanoparticle dispersion in an ethylene glycol/ethanol mixture was used, purchased from Cabot (Cabot Printing Electronics and Displays, USA). This silver ink contains 20 wt % of silver nanoparticles, with a particle diameter ranging from 30 to 50 nm. The viscosity and surface tension of this ink were 14.4 mPa·s and 31 mN $m^{-1}$, respectively.

The foil was mounted in an object-plane of a device according to the invention comprising an elliptical cylinder having a length of 42 cm and an elliptical cross-section with a long axis of 7 cm and a short axis of 5.8 cm. The object-plane was defined by a first focal line and a line parallel to the short axis. The device further comprised a 3000 W tubular Xenon lamp of type LNO EG9902-1(H) extending along a second focal line of the elliptical cylinder.

Figure 7:
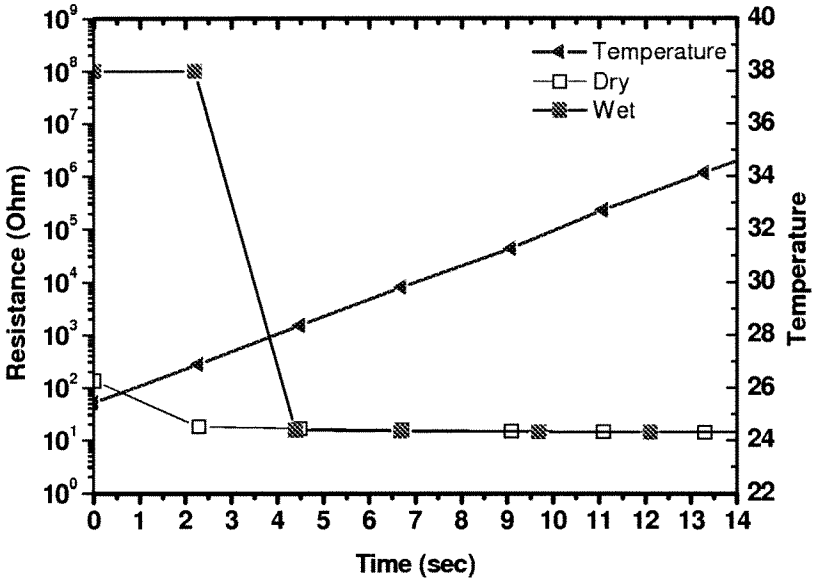
FIG. 7 shows results of a first experiment according to a method of the invention.

A first experiment was carried out according to a method of the invention. Therein a first sample of the foil was provided that was predried by heating during 2 minutes at a temperature of 110° C. A second sample of the foil was provided that was not predried. Both samples were cured at atmospheric pressure by radiation with the Xenon lamp. The samples were arranged with the substance to be cured at a side of the foil opposite to the side of the foil at which the lamp was arranged. The Xenon lamp was operated pulse-wise, with an interval time of 1 second between two subsequent pulses, each pulse consisting of 10 flashes having a duration each of 10 ms. FIG. 7 shows the resistance of the structure at each of the samples as a function of time. Therein the measured resistance of the structure of the predried sample is indicated by open squares, and the measured resistance of the structure of the non-predried sample is indicated by closed squares. As can be seen in FIG. 7, the structure of the predried sample starts with a lower resistance, in the order of $10^2\Omega$, as compared to the resistance of the non-predried structure, having a resistance of $10^8\Omega$. However already within 5 seconds the structure of the non-predried sample has the same resistance as the structure of the predried sample, namely approximately 20Ω. As is further shown by the triangular dots in the Figure, the temperature within the cylinder remains modest. Even after 14 seconds of radiation the temperature is not more than 35 degrees C. Accordingly the present invention allows for a rapid curing of the conductive ink with only a modest heat load.

Figure 8:
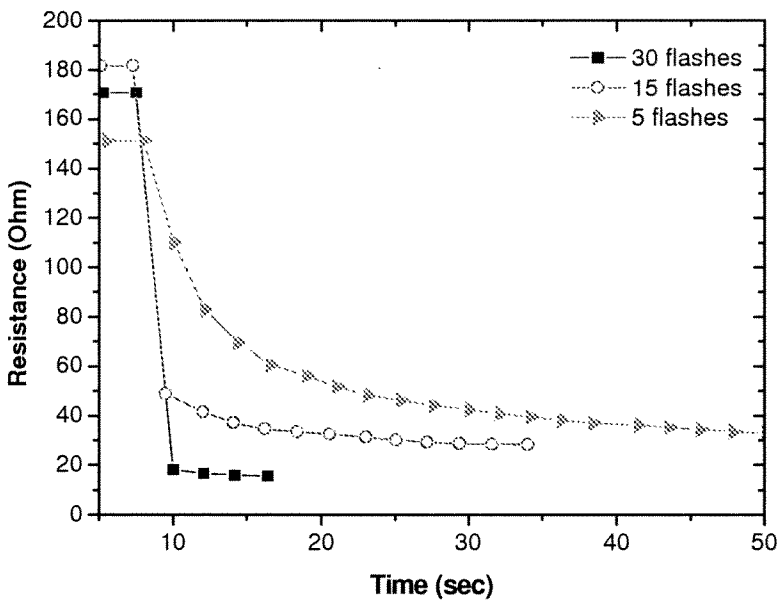
FIG. 8 shows results of a second experiment according to a method of the invention.

FIG. 8 shows results of a second experiment according to a method of the invention. In this second experiment samples equivalent to the first sample as described with reference to FIG. 7 were cured at a mutually different number of flashes per pulse. The other settings of the device were similar as in the first experiment. Again, the samples were arranged with the substance to be cured at a side of the foil opposite to the side of the foil at which the lamp was arranged. FIG. 8 shows the resistance of the conductive structure as a function of time. Therein the resistance of the samples when curing with 30, 15, or 5 flashes per pulse are indicated by square, circular and triangular dots respectively.

Figure 9:
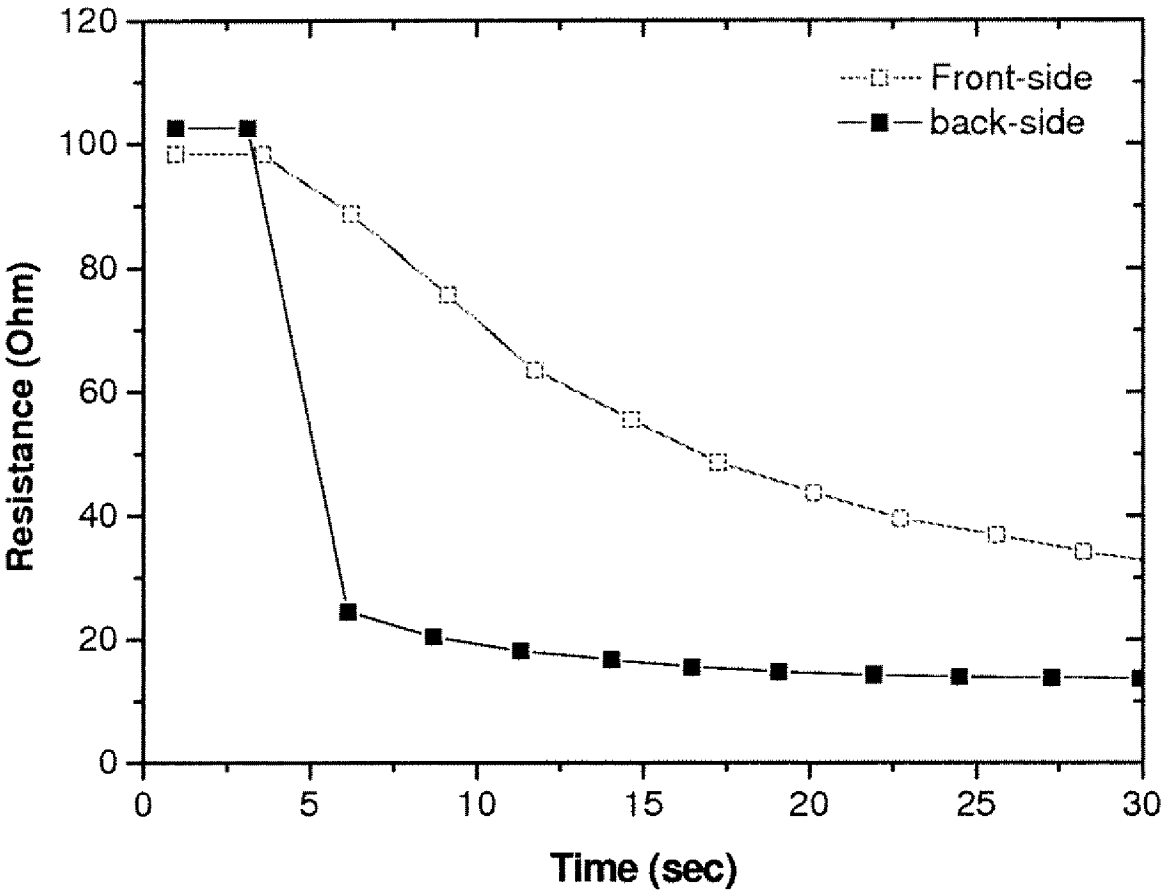
FIG. 9 shows results of a third experiment according to a method of the invention.

FIG. 9 shows results of a third experiment according to the invention. In this third experiment, samples equivalent to the first sample as described with reference to FIG. 7 were cured according to the same settings as according to the first experiment, except that a first one of the samples was positioned with the structure to be cured at the same side as the radiation source (indicated by open squares) and a second one was positioned with the structure to be cured at a side of the foil opposite to the radiation source.

Surprisingly, the second one of the samples showed a substantially faster decrease of the measured resistance than the first one of the samples. It is suspected that this is caused by a slower cooling down of the arrangement wherein the second one of the samples was cured. Effectively the substrate separates the space within the cylinder in two portions of mutually different size that are thermally insulated from each other by the substrate. During a pulse of the lamp, most energy is absorbed by the substance, and not by the cylinder or the atmosphere therein or the substrate, so that the substance is heated rapidly and subsequently cools down due to heat transport to the surrounding space in a period between two pulses. In the arrangement wherein the substance is present at a side of the substrate facing away from the lamp, the substance is located in the smallest of the two portions of the space, and has a smaller heat loss to its environment.

Additional experiments were carried out wherein various Cu-complexes indicated in the following table, were sintered using the apparatus of FIG. 6. For comparison similar samples were thermally sintered using an oven. The complexes were deposited with a pipette on a Polyimide foil 210. The so obtained samples were sintered in the apparatus by operating the photon radiation source 240 at 75% of its maximum power (i.e. 75% of 3000 W) and with 10 flashes per second during a period of 10 s. Due to reflection by the inner surface of the reflective surfaces 252, 254 the pattern formed by the Cu-complexes deposited at the foil is exposed double sided.

| Cu-complex | Resistance after oven sintering | Resistance after flash sintering |
|---|---|---|
| $Cu(neodecanaote)_2$ (6-12% Cu; from Strem Chemicals) | >100 MΩ (2 h @ 200° C.) | 1-2 MΩ |
| $Cu(acetate)_2 \cdot H_2O$ (from Sigma Aldrich) complex with ethanolamine is soluble in water (concentration N/A) | >100 MΩ (2 h @ 170° C.) | 1-2 MΩ |
| $Cu(formate)_2 \cdot 4\ H_2O$ (from Gelest) | >100 MΩ (0.5 h @ 170° C.) | 1-2 MΩ |

The results shown in the table above demonstrate that with thermal sintering no conductivity at all can be obtained. This is probably caused by oxidation of the generated metallic during the thermal process. With flash sintering using the apparatus of FIG. 6 a clear improvement of conductivity is obtained as this process is very fast so that only a limited oxidation of the Cu occurs.

Figure 10:
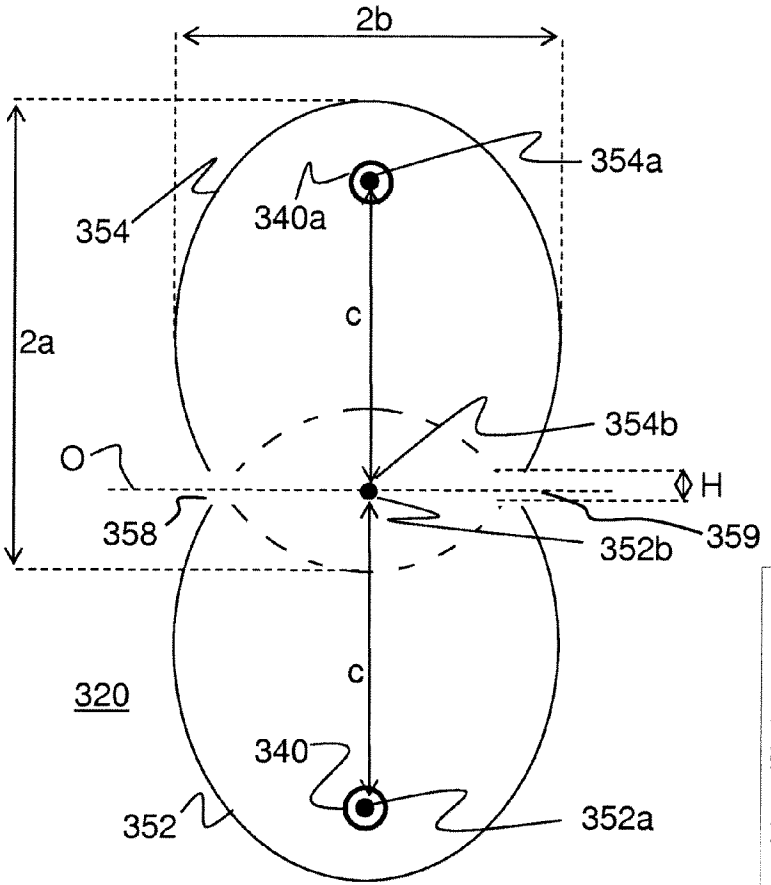
FIG. 10 shows a third embodiment of a device according to the invention, in a cross-section transverse to length axis L.

FIG. 10 schematically shows a cross-section of a third embodiment of a device according to the invention. Parts therein have a reference number that is 100 higher than corresponding parts in FIG. 4. In this third embodiment the first reflective surface 352 has a first and a second focal line 352*a*, 352*b*. The second concave reflective surface 354 also has first and a second focal line 354*a*, 354*b*. The second focal lines 352*b*, 354*b* of the first and the second concave reflective surfaces 352, 354 substantially coincide with each other in the object-plane O. The tubular radiator 340 substantially coincides with the first focal line 352*a* of the first concave reflective surface 352. I.e. the tubular radiator 340 surrounds the first focal line 352*a* of the first concave reflective surface 352. In this embodiment the first focal line 352 coincide with the axis of the tubular radiator 340 with a tolerance of 1 mm. An additional tubular radiator 340*a* is present that substantially coincides with the first focal line 354*a* of the second concave reflective surface 354. I.e. the tubular radiator 340*a* surrounds the first focal line 354*a* of the first concave reflective surface 354. In this embodiment the first focal line 354*a* coincide with the axis of the tubular radiator 340*a* with a tolerance of 1 mm.

The concave reflective surfaces 352, 354 are both formed by a section of a respective ellipsoidal cylinder that is coated at its inner side with aluminium foil having a reflectivity of 98%. The section is formed by truncation along the length axis of the cylinder. The truncated portion of the cylinder is indicated by the dotted lines. In this specific set-up, a gap H of 10 mm is present between the truncated elliptical cylinders that form the concave reflective surfaces 352, 354. The gap allows a substrate to pass through the object-plane. The smaller the truncated portion of the cylinder, the more light will be reflected to the coinciding focal line. If 50% or more of the cylinder would be truncated, the advantages of this invention will disappear. Hence, the smaller the gap between the truncated elliptical cylinders, the more efficient the reflector set-up will be. In this specific set-up the ellipses in untruncated form would have a large axis 2*a* of 140 mm and a short axis 2*b* of 114.8 mm. Accordingly the distance c between their first and second focal lines is 80 mm. The second focal lines substantially coincide, in that their distance is less than one fifth (32 mm) the distance between the first focal lines. In particular the distance is less than one tenth (16 mm) the distance between the focal lines. In this case the second focal lines coincide with a tolerance of 1 mm.

In the embodiment shown the device has a further tubular radiator 340*a* that substantially coincides with the first focal line 354*a* of the second concave reflective surface 354.

The tubular radiators 340, 340*a* are Xenon lamps of type Philips XOP-15 (1000 W, length 39.5 cm) with a diameter of about 1 cm. Dependent on the dimensions of the foil that is to be processed also a tubular radiator of a different length may be used e.g. a Xenon lamp of type Philips XOP-25 (1000 W, length 54.0 cm), also with a diameter of about 1 cm. Also flash lamps having another gas filling may be used, e.g. Kr-lamps or Xe/Kr-lamps. It is merely relevant that the radiation source is capable of providing a high energy dose in a pulse wise operation. If desired different radiation sources may be used for the tubular radiators 340, 340*a*.

The tubular radiators 340, 340*a*, can be activated independent from each other or simultaneously. Dependent on the application, flash duration, number of flashes per pulse, number of pulses per second and energy all can be tuned. In the present application a total energy flux of about 1000 J/s was found suitable.

A series of further experiments was conducted using the device of FIG. 10. In these experiments a PEN (Polyethylene Naphthalate) foil produced by DuPont Teijin with a thickness of 125 μm was used as the substrate in the experiments. The samples were printed on the smoothest side of the foil.

In the series of further experiments two printing techniques were used, namely inkjet technology and by screen printing.

Inkjet printing was performed using a piezoelectric Dimatix DMP 2800 (Dimatix-Fujifilm Inc., USA), equipped with a 10 pL cartridge (DMC-11610). The print head contains 16 parallel squared nozzles with a diameter of 30 μm. The dispersion was printed at a voltage of 28 V, using a frequency of 10 kHz and a customized wave form. The printing height was set to 0.5 mm, while using a dot spacing of 20 μm. Two inkjet inks were used namely the Cabot AG-IJ-G-100-S1 ink (also referred to as I1) and the InkTec TEC-IJ-040 ink. When InkTec ink was used to print the lines, the plate temperature was set on 60° C. to make sintering of InkTec ink possible. The plate temperature of the inkjet printer was set on room temperature during printing of Cabot ink. Estimated deposited layer thickness after sintering is for Cabot circa 400 nm and for the InkTec ink circa 300 nm.

Screen printing was performed using a DEK Horizon screen printer (DEK international, GmbH, USA) with a gull wing cover design and a screen with a mesh opening of 40 μm and a wire thickness of 0.025 mm. Two screen print inks were used namely DuPont 5025 ink (S0) and InkTec TEC-PA-010 ink (S2). Estimated layer thickness after sintering is for DuPont circa 8000 nm and for InkTec circa 2467 nm.

A measuring probe was designed which allowed measuring of the ink line with a four point resistance measurement so that the resistance of the wires and contact points could be neglected. A Keithley 2400 source meter was connected to a PC and used both as a current source and a voltmeter. This allowed data to be acquired in real time and then, subsequently, imported into an Excel template for further analysis. A Memmert Model 400 oven was used to dry and sinter the measuring probe. The printed measurement probes were sintered in the oven at a temperature of 135° C. for 30 minutes. Wet ink lines with a width of 100 μm and a length of 25 mm were then printed on the contact points.

The apparatus shown in FIG. 1 was used in three operational modes.

F: Only illumination on the front side of the ink line

B: Only illumination on the backside of the ink line

F+B: Illumination simultaneously on the front and backside of the ink line

Operational mode F was realized by covering the reflective surfaces on the right hand of the line II-II with an absorbing layer and by orienting the foil in a plane defined by the length axis L of the tube and the line II-II with the coated surface of the foil 10 facing to the left. Likewise operational mode was realized in that arrangement by turning the coated surface of the foil 10 to the right.

In these three operational modes the energy flux is mutually equal. This is realized by controlling the flashing frequency of the radiation sources. A frequency of 5 flashes per second was used to illuminate both sides of the ink line and a frequency of 10 flashes per second was used when only one side is illuminated. A ventilation system was placed within the flash set up to ensure that the temperature in the ellipse did not exceed temperatures that could have influenced the quality of the substrate. The allowed temperature depends on the substrate used, e.g. 120° C. for a PET-foil, 140° C. for a PEN foil or even higher in the case of a polyimide foil. Also an aluminium reflection layer with a reflection of 98% was glued to the inside of the ellipse to increase the reflection. To control the settings of the lamp, for example, the intensity of the light, a computer program was created which also made it possible to simultaneously measure the resistance of the ink line during the experiment. To create a difference between front side illumination and backside illumination half of the opposite side of the elliptical mirror was covered with a black cloak.

Results of the further experiments are summarized in the following three tables. Therein the letters F, B and F+B stand for Front side illumination, Backside illumination and Front and Backside illumination, respectively.

The variable TS indicates the time when the ink line started to show conductivity as a result of illumination. Therefore, for TS=0, the ink line directly started to decrease in resistance due to the illumination.

For experiments 1 and 3 the term R30 refers to the achieved resistance after 30 seconds of illumination. The 30 seconds of illumination begins at the moment the ink line which is illuminated at both sides (F+B) begins to sinter. For experiment 2 the term R60 refers to the resistance achieved after 60 seconds of illumination.

The variable γ indicates the improvement achieved by double sided radiation. This variable γ is calculated as:

$$\gamma = \frac{\int_{TS}^{TS+\Delta T} \log R_{double}\, dt}{\int_{TS}^{TS+\Delta T} \log R_{ref}\, dt}$$

The following table shows the result of further experiment A1, wherein the sintering behaviour of silver nanoparticles and silver flakes is measured.

| | | F | | B | | F + B | | |
|---|---|---|---|---|---|---|---|---|
| Ink | Printing | TS(s) | R30(Ω) | TS(s) | R30(Ω) | TS(s) | R30(Ω) | γ |
| S0 | Screen | 0 | 106.98 | 0 | 111.7 | 0 | 64.84 | 1.14 |
| I1 | Inkjet | 64.4 | 1202807 | 63.59 | 624 | 48.5 | 94.43 | 8.21 |
| S1 | Screen | 15.8 | 1.6E+07 | 8.3 | 1E+06 | 0 | 19.87 | 8.23 |

Figure 11:
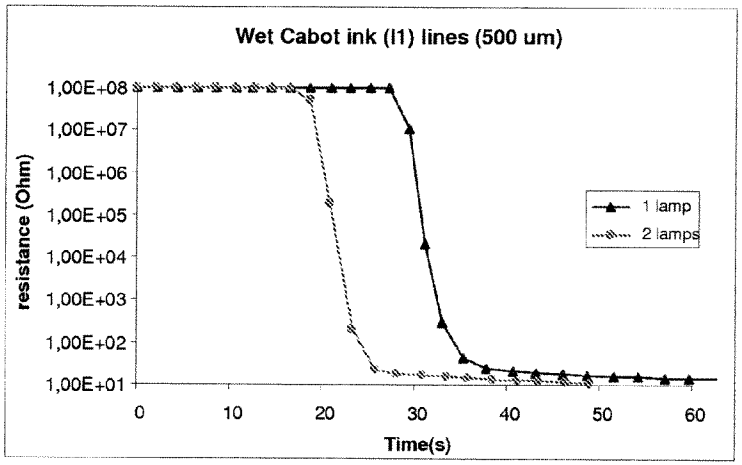
FIG. 11 shows results of a measurement of this obtained from an experiment with the device of FIG. 10.

It is remarkable that application of double sided radiation only results in a modest improvement for the ink of type S0, comprising silver flakes, while for inks I1, S1 both an improvement of 8 orders of magnitude is obtained. The recipes of the latter two inks are both on the basis of silver nanoparticles. The improvement is substantially independent of the printing method used, despite the different thickness of the features obtained by these methods, i.e. about 400 nm for the inkjet printed features and about 2500 nm for the screen printed features. For illustration, FIG. 11 shows the behaviour of the resistance as a function of time of features applied by inkjet printing the ink of type I1, both for single sided illumination and for double sided illumination. Also here it can be observed that the application of double sided illumination (B+F), 2 lamps)) results in a shorter sintering time and/or a lower end-resistance R30 than in the case of only front-side illumination (F, 1 lamp).

The following table shows the result of further experiment A2, wherein the sintering behaviour of silver complexes and silver flakes is measured.

| | | F | | B | | F + B | | |
|---|---|---|---|---|---|---|---|---|
| Ink | Printing | TS(s) | R60(Ω) | TS(s) | R60(Ω) | TS(s) | R60(Ω) | γ |
| S0 | Screen | 0 | 106.98 | 0 | 111.65 | 0 | 64.84 | 1.14 |
| I2 | Inkjet | 206.05 | 1570288 | 224.81 | 5E+06 | 176.25 | 763.92 | 14.92 |

Also in this case application of double sided radiation only results in a modest improvement for the ink of type S0, comprising silver flakes, while for ink I2, based on silver complexes, a significant improvement in γ-value is obtained.

In further experiment A3 the dependency of sintering behaviour on the number of layers (n=1, n=2, n=3) is investigated both for ink S0 and ink S1. In each case the inks are printed by the screen printing method described above.

| | F | | B | | F + B | | |
|---|---|---|---|---|---|---|---|
| Ink | TS(s) | R30(Ω) | TS(s) | R30(Ω) | TS(s) | R30(Ω) | γ |
| S0 n = 1 | 0 | 166.63 | 0 | 166.63 | 0 | 94.04 | 1.14 |
| S1 n = 1 | 15.8 | 15735570 | 8.3 | 1E+06 | 0 | 19.87 | 8.23 |
| S1 n = 2 | 6.48 | 293710.5 | 4.46 | 74167 | 0 | 10.06 | 7.12 |
| S1 n = 3 | 13.12 | 470590.3 | 8.97 | 3259.9 | 0 | 14.21 | 7.12 |

Also in this case it can be confirmed that application of double sided radiation only results in a modest improvement for the ink of type S0, comprising silver flakes, while for ink S1, based on silver silver nanoparticles, a significant improvement γ is obtained and this for comparable layer thicknesses (layer thickness S0, n=1≈layer thickness S1, n=3.

In the claims the word "comprising" does not exclude other elements or steps, and the indefinite article "a" or "an" does not exclude a plurality. A single component or other unit may fulfil the functions of several items recited in the claims. The mere fact that certain measures are recited in mutually different claims does not indicate that a combination of these measures cannot be used to advantage. Any reference signs in the claims should not be construed as limiting the scope.

What is claimed is:

1. A device for curing patterns of a substance at a surface of a foil comprising a carrier facility for carrying the foil within an object plane, a photon radiation source arranged at a first side of the object plane for emitting photon radiation in a wavelength range for which the foil is transparent, a first and a second concave reflective surface arranged at mutually opposite sides of the object plane, for mapping photon radiation emitted by the photon radiation source into the object plane, the photon radiation source being arranged between the first concave reflecting surface and the object-plane, characterized in that the photon radiation of the photon radiation source is concentrated into the object plane by the first and the second concave reflective surface wherein the photon radiation source is a tubular radiator with a length-axis and the first and the second reflecting surfaces are cylindrical surfaces extending along the length axis, and wherein the first and the second concave reflective surface each have a first and a second focal line, wherein the second focal lines of the first and the second concave reflective surfaces at least substantially coincide with each other in the object-plane, and wherein the tubular radiator at least substantially coincides with the first focal line of one of the first and the second concave reflective surfaces.

2. A device according to claim 1, wherein the cylindrical surfaces are elliptical cylindrical surfaces.

3. A device according to claim 1, having a further tubular radiator that at least substantially coincides with the first focal line of the other one of the first and the second concave reflective surfaces.

4. A device according to claim 1, wherein the cylindrical surfaces are formed by an inner surface of a tube.

5. A device according to claim 1, wherein the cylindrical surfaces are connected at their ends by end parts, the cylindrical surfaces and the end-parts forming a substantially closed environment.

6. A device according to claim 1, wherein the tube is provided with at least a first slit shaped opening extending in the direction of the length axis, wherein the carrying facility forms a guidance facility for guiding the foil through the at least slit-shape opening along the object-plane.

7. A device according to claim 1, wherein a first and a second slit-shaped opening are defined between the first and the second reflecting surface, which first and second slit-shaped openings extend opposite to each other in the direction of the length axis, and wherein the carrying facility forms a guidance facility that during an operational state guides the foil via the first slit-shaped opening towards the object-plane between the first and the second reflective surfaces and away from there via the second slit-shaped opening.

8. A device according to claim 7, wherein the first and second concave reflective surface have a total area that is at least 5 times an area formed by the first and the second slit-shaped openings.

9. A device according to claim 4, wherein the end-parts each are provided with a ventilation facility.

10. A device according to claim 1, having a single photon radiation source that is arranged at a side of the substrate opposite to a side of the substrate comprising the substance.

11. A system comprising a device according to claim 1 and further comprising a controller for controlling at least the photon radiation source.

12. Method for curing patterns of a substance at a surface of a foil comprising the steps of carrying the foil within an object plane, emitting photon radiation by a tubular radiator with a length-axis from a first side of the object plane in a wavelength range for which the foil is transparent, mapping a first part of the emitted photon radiation directly by reflection at a first concave cylindrical reflecting surface extending along the length axis towards the object plane, mapping by reflection at a second concave cylindrical reflecting surface extending along the length axis a second part of the emitted photon radiation that is transmitted by the foil by reflection towards the object plane, characterized in that the mapped first part and second part of the photon radiation of the photon radiation source is concentrated into the object plane, wherein the first and the second concave reflective surface each have a first and a second focal line, wherein the second focal lines of the first and the second concave reflective surfaces at least substantially coincide with each other in the object-plane, and wherein the tubular radiator at least substantially coincides with the first focal line of one of the first and the second concave reflective surfaces.

13. A device according to claim 2, wherein the cylindrical surfaces are formed by an inner surface of a tube.

14. A device according to claim 2, wherein the cylindrical surfaces are connected at their ends by end parts, the cylindrical surfaces and the end-parts forming a substantially closed environment.

15. A device according to claim 3, wherein the cylindrical surfaces are connected at their ends by end parts, the cylindrical surfaces and the end-parts forming a substantially closed environment.

16. A device according to claim 3, wherein the tube is provided with at least a first slit shaped opening extending in the direction of the length axis, wherein the carrying facility forms a guidance facility for guiding the foil through the at least slit-shape opening along the object-plane.

17. A device according to claim 2, wherein a first and a second slit-shaped opening are defined between the first and the second reflecting surface, which first and second slit-shaped openings extend opposite to each other in the direction of the length axis, and wherein the carrying facility forms a guidance facility that during an operational state guides the foil via the first slit-shaped opening towards the object-plane between the first and the second reflective surfaces and away from there via the second slit-shaped opening.

18. A device according to claim 3, wherein a first and a second slit-shaped opening are defined between the first and the second reflecting surface, which first and second slit-shaped openings extend opposite to each other in the direction of the length axis, and wherein the carrying facility forms a guidance facility that during an operational state guides the foil via the first slit-shaped opening towards the object-plane between the first and the second reflective surfaces and away from there via the second slit-shaped opening.

19. A device according to claim 4, wherein a first and a second slit-shaped opening are defined between the first and the second reflecting surface, which first and second slit-shaped openings extend opposite to each other in the direction of the length axis, and wherein the carrying facility forms a guidance facility that during an operational state guides the foil via the first slit-shaped opening towards the object-plane between the first and the second reflective surfaces and away from there via the second slit-shaped opening.

20. A device according to claim 5, wherein a first and a second slit-shaped opening are defined between the first and the second reflecting surface, which first and second slit-shaped openings extend opposite to each other in the direction of the length axis, and wherein the carrying facility forms a guidance facility that during an operational state guides the foil via the first slit-shaped opening towards the object-plane between the first and the second reflective surfaces and away from there via the second slit-shaped opening.

* * * * *